US006814061B2

(12) United States Patent
Everingham

(10) Patent No.: US 6,814,061 B2
(45) Date of Patent: Nov. 9, 2004

(54) UNIPOLAR CANISTER PURGE VALVE

(75) Inventor: Gary Everingham, Chatham (CA)

(73) Assignee: Siemens VDO Automotive Inc., Chatham, CA (US)

( * ) Notice: Subject to any disclaimer, the term of this patent is extended or adjusted under 35 U.S.C. 154(b) by 0 days.

(21) Appl. No.: 10/253,222

(22) Filed: Sep. 24, 2002

(65) Prior Publication Data

US 2004/0055583 A1 Mar. 25, 2004

(51) Int. Cl.[7] ..... F02M 33/02
(52) U.S. Cl. ..... 123/520; 137/315.03
(58) Field of Search ..... 123/520, 519, 123/518, 516; 251/129.1, 129.09, 129.15; 137/315.03

(56) References Cited

U.S. PATENT DOCUMENTS 5,460,148 A * 10/1995 Suzumura et al. ..... 123/585
6,170,766 B1 * 1/2001 Focke et al. ..... 239/585.1
6,526,951 B2 * 3/2003 Ishigaki et al. ..... 123/519
6,581,904 B2 * 6/2003 Watanabe et al. ..... 251/129.17

* cited by examiner

*Primary Examiner*—Mahmoud Gimie

(57) ABSTRACT

A canister purge valve for use in an evaporative emission control system. The valve includes a housing having an inlet port and an outlet port. The housing further includes a guide element having a bobbin section. A valve shaft is slidably mounted to the guide element, wherein the valve shaft includes a permanent magnet and a valve element. The valve element is movable between a closed position wherein the inlet port is closed and an open position wherein the inlet port is opened. A pick coil is formed on the bobbin adjacent the magnet. The pick coil generates a first magnetic field having a polarity that is oriented to cause a magnetic attraction with the magnet to move the magnet and thus the valve element to the open position. In addition, a release coil is formed on the bobbin adjacent to the magnet, wherein the release coil generates a second magnetic field having a polarity that is oriented to cause the magnet to be repelled to move the magnet and thus the valve element to the closed position.

17 Claims, 3 Drawing Sheets

UNIPOLAR CANISTER PURGE VALVE

FIELD OF THE INVENTION

This invention relates to evaporative emission control systems for internal combustion engines, and more particularly, to a canister purge valve having a pick coil and a release coil which interact with a permanent magnet to selectively open and close a valve element.

BACKGROUND OF THE INVENTION

Motor vehicles having an internal combustion engine typically include an evaporative emission control system which serves to reduce fuel vapor emissions. Such systems include a vapor collection canister having carbon or other similar material which serves to absorb fuel vapors that are generated within a fuel system. A canister purge valve is located between the canister and an engine intake manifold. The canister purge valve may be opened or closed to either place the canister in fluid communication with the engine intake manifold or to isolate the canister from the engine intake manifold, respectively.

Under the appropriate conditions, the canister is purged so that fuel vapors collected within the canister do not undesirably escape into the atmosphere. This is done by opening the canister purge valve, thus enabling vacuum which is present at the engine intake manifold to draw out the fuel vapors from the canister. The fuel vapors are then used in the normal combustion process.

The canister purge valve typically includes a valve that is actuated by a solenoid having an armature and a stator. One method of opening or latching the valve is to use a coil to generate a magnetic field so as to cause the armature to magnetically "stick" to the stator. In order to release the armature, an opposing magnetic force is applied to the stator, which causes the stator to repel the armature to thus close the valve. This is typically done by reversing polarity on the coil through the use of a driver circuit known as an "H" driver. However, the use of such drivers increases costs and complexity.

SUMMARY OF THE INVENTION

The invention is directed to a solenoid for use in a canister purge valve. The valve includes a housing having an inlet port and an outlet port. The housing further includes a guide element having a bobbin section. A valve shaft is slidably mounted to the guide element, wherein the valve shaft includes a permanent magnet and a valve element. The valve element is movable between a closed position wherein the inlet port is closed and an open position wherein the inlet port is opened. A pick coil is formed on the bobbin adjacent the magnet. The pick coil generates a first magnetic field having a polarity that is oriented to cause a magnetic attraction with the magnet to move the magnet and thus the valve element to the open position. In addition, a release coil is formed on the bobbin adjacent to the magnet, wherein the release coil generates a second magnetic field having a polarity that is oriented to cause the magnet to be repelled to move the magnet and thus the valve element to the closed position.

The features of the invention believed to be novel are set forth with particularity in the appended claims. The invention itself, however, both as to organization and method of operation, may be best understood by reference to the following description taken in conjunction with accompanying drawings.

DETAILED DESCRIPTION OF THE INVENTION

Figure 1:
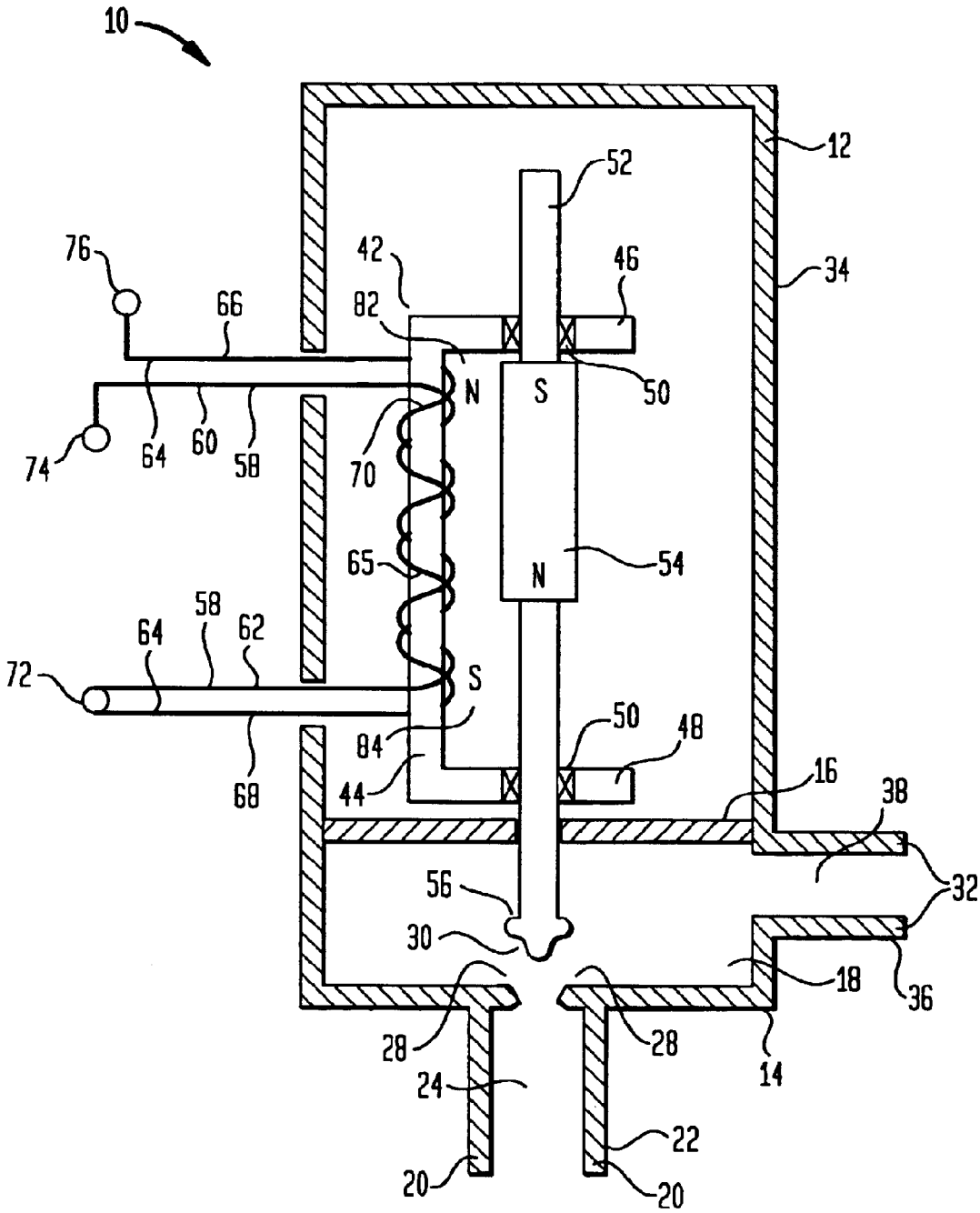
FIG. 1 is a cross sectional view of a canister purge valve depicting an energized pick coil for opening an inlet port.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in the several views of FIGS. 1–3.

Figure 3:
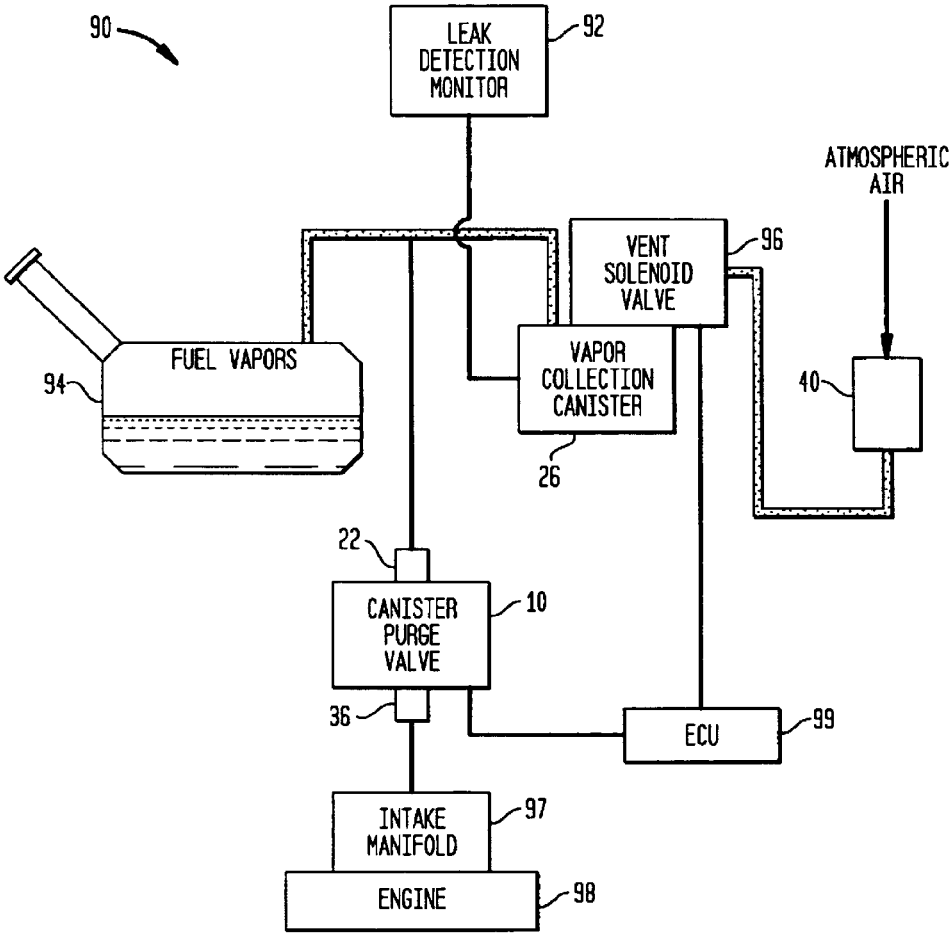
FIG. 3 is an illustrative depiction of the canister purge valve in an evaporative emission control system.

Referring to FIG. 1, a cross sectional view of a canister purge valve 10 in accordance with the present invention is shown. The purge valve 10 includes a housing 12 having a lower wall 14 and an internal wall 16 for forming an internal passageway 18. Inlet port walls 20 extend from the lower wall 14 to form an inlet port 22 having a first passageway 24 which is in fluid communication with a vapor collection canister 26 (FIG. 3). A valve seat 28 for receiving a valve element 30 is formed at the intersection of the inlet port walls 20 and the lower wall 14. Outlet port walls 32 extend from a side wall 34 of the housing 12 to form an outlet port 36 having a second passageway 38 which is in fluid communication with an engine intake manifold 97 (FIG. 3).

The housing 12 further includes a guide member 42 having a bobbin section 44 located between upper 46 and lower 48 flanges that extend outwardly to form a substantially C-shaped configuration. The upper 46 and lower 48 flanges each include bearings 50 for enabling movement of a shaft 52 along an axial direction. It is noted that other devices and configurations for enabling movement may be used such as bushings. The shaft 52 includes a permanent magnet 54 that is located between the upper 46 and lower 48 flanges. A lower end 56 of the shaft 52 includes the valve element 30. In FIG. 1, the valve element 30 is depicted in an open position wherein the valve element 30 is spaced apart from the valve seat 28 to enable fluid communication between the inlet port 22, the internal passageway 18 and the outlet port 36. The valve element 30 may also be moved to a closed position wherein the valve element 30 is in contact with the valve seat 28 to thus close the inlet port 22 as will be described in relation to FIG. 2.

A first wire 58 having first 60 and second 62 ends is wound around a section of the bobbin 44 to form a pick coil 65. A second wire 64 having third 66 and fourth 68 ends is wound around the same section of the bobbin 44 to form a release coil 70. The pick 64 and release 70 coils are located adjacent the magnet 54. The second 62 and fourth 68 ends are connected to a base terminal 72 and the first 60 and third 66 ends are connected to first 74 and second 76 power terminals, respectively.

In one embodiment, the magnet 54 is oriented such that the south magnetic pole is located above the north magnetic pole. The pick coil 65 is energized by maintaining the base terminal 72 at 0 volts and the first power terminal 74 at a positive voltage such as approximately +12 volts, for example. The pick coil 65 is wound such that a magnetic field is generated having north and south magnetic poles oriented near top 82 and bottom 84 portions, respectively, of the pick coil 65. As a result, the polarity of the magnetic field along the bobbin 44 is oriented to magnetically attract the magnet 54, thus causing the valve element 30 to move upward to the open position as shown in FIG. 1.

Figure 2:
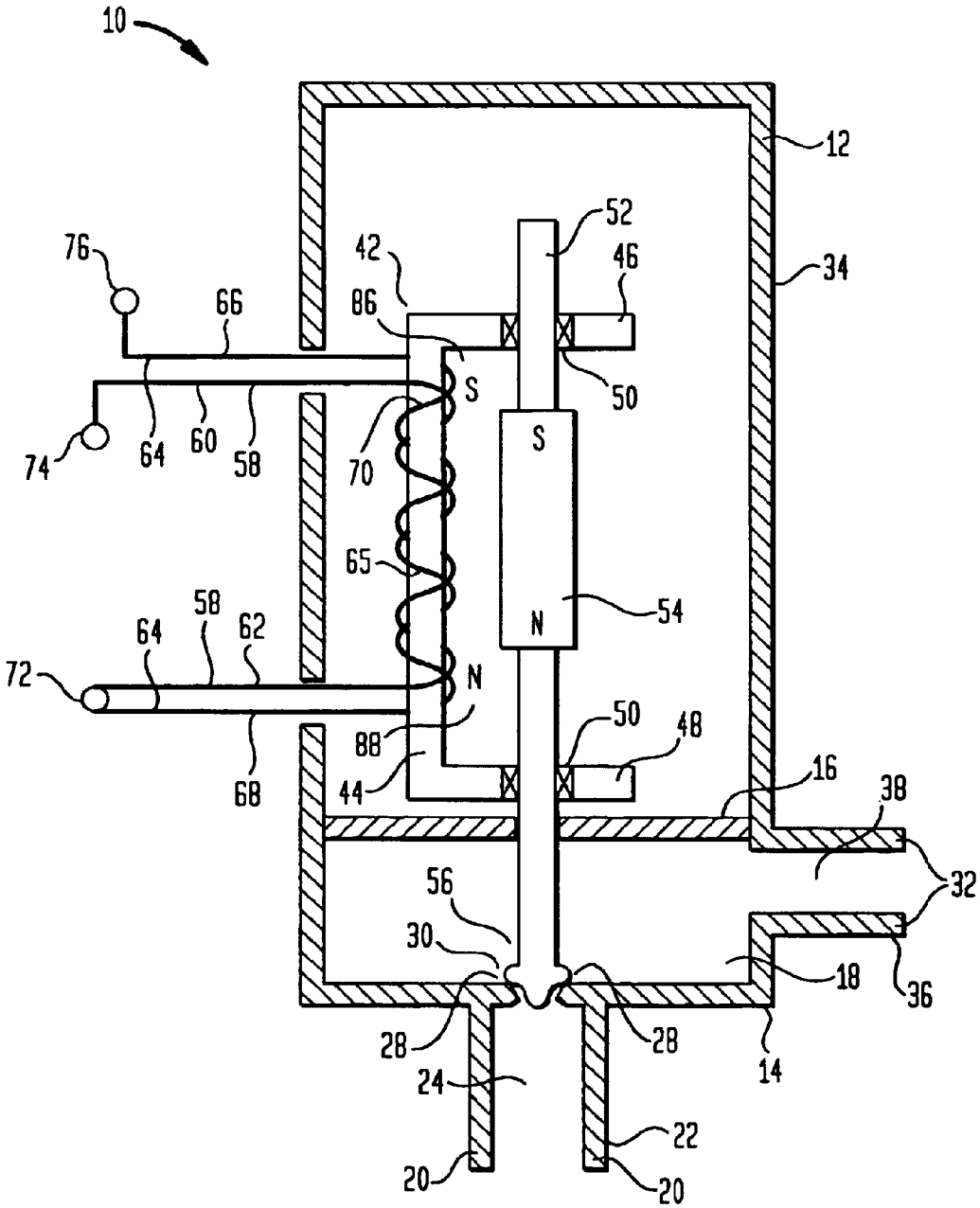
FIG. 2 is a cross sectional view of a canister purge valve depicting an energized release coil for closing the inlet port.

Referring to FIG. 2, the valve element 30 is shown in the closed position. In order to move the valve element 30 to the closed position, the pick coil 65 is de-energized. The release coil 70 is then energized by maintaining the base terminal 72 at 0 volts and the second power terminal 76 at a positive voltage such as approximately +12 volts, for example. The release coil 70 is wound such that a magnetic field is generated having south and north magnetic poles oriented near top 86 and bottom 88 portions, respectively, of the release coil 70. As a result, the orientation of the magnetic poles along the bobbin 44 is reversed from that which occurs when the pick coil 65 is energized. This causes the magnet 54 to be repelled, thus causing the valve element 30 to move downward to the closed position as shown in FIG. 2. As such, the polarity along the bobbin 44 is reversed without the use of expensive H drivers. In particular, the present invention enables the use of simpler and less expensive drivers commonly found in current engine electronic control units such as single ended drivers.

In order to move the valve element 30 back to the open position, the release coil 70 is de-energized. The pick coil 65 is again energized to move the valve element 30 back to the open position as described above. As such, the pick 65 and release 70 coils may be selectively energized and de-energized to cause movement of the valve element 30 between the open and closed positions. It is noted that other suitable voltages may be used to energize either the pick 65 or release 70 coils. Further, it noted that the polarity of the magnet 54 and that of the magnetic field generated by the pick 65 and release 70 coils may be correspondingly reversed as desired to enable movement of the valve element 30 between the open and closed positions.

Referring to FIG. 3, the purge valve 10 in accordance with the present invention is shown in an emission control system 90. The system 90 includes a leak detection monitor 92 which is used as part of a selected on board diagnostic procedure for determining whether there is a fuel vapor leak in the system 90 that is above a predetermined level.

The canister 26 is in fluid communication with a fuel tank 96 and includes carbon or other similar material which serves to absorb fuel vapors that are generated within a fuel tank 94 and in the emission control system 90. The canister 26 also includes a vent solenoid valve 96 which is opened under the appropriate conditions so as to place the canister 26 in fluid communication with atmospheric air through a filter 40. Alternatively, the vent valve 96 is closed to isolate the canister 26 from atmospheric air so as to enable performance of an on board diagnostic procedure.

The purge valve 10 is located between the canister 26 and the engine intake manifold 97 of an internal combustion engine 98. The purge valve 10 may be opened as previously described in relation to FIG. 1 to place the canister 26 in fluid communication with the intake manifold 97. Alternatively, the purge valve 10 may be closed as previously described in relation to FIG. 2 to isolate the canister 26 from the intake manifold 97. The opening and closing of both the purge valve 10 and the vent valve 96 is controlled by an engine electronic control unit (ECU) 99.

Under the appropriate conditions, the canister 26 is purged so that fuel vapors collected within the canister 26 do not undesirably escape into the atmosphere. This is done by opening both the purge valve 10 and the vent valve 96, thus enabling vacuum which is present at the intake manifold 97 to draw in atmospheric air through the canister 26 and then draw out the fuel vapors from the canister 26. The purged fuel vapors are then used in the normal combustion process. The ECU 99 determines when purging is to occur based on received signals indicative of various engine parameters. Further, the ECU 99 may be programmed to allow purging of the canister 26 at differential rates depending upon the prevailing engine operating conditions. As such, greater amounts of purging may be permitted at certain times while at other times lesser amounts may be allowed.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A solenoid for use in a canister purge valve, comprising:

a housing having an inlet port and an outlet port;

a guide element located in said housing, said guide element including a bobbin section;

a valve shaft slidably mounted to said guide element, said valve shaft having a permanent magnet and a valve element wherein said valve element is movable between a closed position wherein said inlet port is closed and an open position wherein said inlet port is opened;

a pick coil formed on said bobbin adjacent said magnet, wherein said pick coil generates a first magnetic field having a polarity that is oriented to cause a magnetic attraction with said magnet to move said magnet and thus said valve element to said open position; and a release coil formed on said bobbin adjacent to said magnet, wherein said release coil generates a second magnetic field having a polarity that is oriented to cause said magnet to be repelled to move said magnet and thus said valve element to said closed position.

2. The solenoid according to claim 1, wherein a positive voltage is applied to said pick coil to move said valve element to said open position.

3. The solenoid according to claim 2 wherein said voltage is approximately 12 volts.

4. The solenoid according to claim 1, wherein a positive voltage is applied to said release coil to move said valve element to said closed position.

5. The solenoid according to claim 4, wherein said voltage is approximately 12 volts.

6. A method for operating a valve, comprising the steps of:

providing a housing having a inlet port and an outlet port;

providing a valve shaft having a permanent magnet and a valve element, wherein said valve element is movable between a closed position wherein said inlet port is closed and an open position wherein said inlet port is opened;

generating a first magnetic field having a polarity that is oriented to cause a magnetic attraction with said magnet to move said magnet and thus said valve element to said open position; and generating a second magnetic field having a polarity that is oriented to cause said magnet to be repelled to move said magnet and thus said valve element to said closed position.

7. The method according to claim 6, wherein said step of generating a first magnetic field includes providing a positive voltage to a pick coil.

8. The method according to claim 7, wherein said voltage is approximately 12 volts.

9. The method according to claim 6, wherein said step of generating a second magnetic field includes providing a positive voltage to a release coil.

10. The method according to claim 9, wherein said voltage is approximately 12 volts.

11. An evaporative emission control system, wherein said system is in fluid communication with a fuel tank that generates fuel vapors, comprising:

a vapor collection canister in fluid communication with said fuel tank for absorbing fuel vapors in said system;

a vent valve in fluid communication with said canister for enabling venting of said canister to atmosphere;

a leak detection monitor for determining whether there are leaks in said system which are greater than a predetermined level;

a canister purge valve for purging said canister, said canister purge valve further comprising:

a housing having an inlet port in fluid communication with said canister and an outlet port in fluid communication with an intake manifold of an engine;

a guide element located in said housing, said guide element including a bobbin section;

a valve shaft slidably mounted to said guide element, said valve shaft having a permanent magnet and a valve element wherein said valve element is movable between a closed position wherein said inlet port is closed and an open position wherein said inlet port is opened;

a pick coil formed on said bobbin adjacent said magnet, wherein said pick coil generates a first magnetic field having a polarity that is oriented to cause a magnetic attraction with said magnet to move said magnet and thus said valve element to said open position;

a release coil formed on said bobbin adjacent to said magnet, wherein said release coil generates a second magnetic field having a polarity that is oriented to cause said magnet to be repelled to move said magnet and thus said valve element to said closed position; and an electronic engine control unit for controlling opening and closing of said vent valve and said canister purge valve to enable purging of said canister and performance of an on board diagnostic procedure, wherein said engine control unit includes drivers for energizing said pick and release coils.

12. The system according to claim 11, wherein a positive voltage is applied to said pick coil to move said valve element to said open position.

13. The system according to claim 12 wherein said voltage is approximately 12 volts.

14. The system according to claim 11, wherein a positive voltage is applied to said release coil to move said valve element to said closed position.

15. The system according to claim 14, wherein said voltage is approximately 12 volts.

16. The system according to claim 11 further including bearings for enabling movement of said valve shaft.

17. The system according to claim 11 further including a filter in fluid communication with said vent valve.

* * * * *